US011133600B2

(12) United States Patent
Yang et al.

(10) Patent No.: US 11,133,600 B2
(45) Date of Patent: Sep. 28, 2021

(54) SPATIAL FEEDING END-FIRE ARRAY ANTENNA BASED ON ELECTROMAGNETIC SURFACE TECHNOLOGIES

(71) Applicant: Tsinghua University, Beijing (CN)

(72) Inventors: Fan Yang, Beijing (CN); Min Wang, Beijing (CN); Shenheng Xu, Beijing (CN); Maokun Li, Beijing (CN)

(73) Assignee: TSINGHUA UNIVERSITY, Beijing (CN)

( * ) Notice: Subject to any disclaimer, the term of this patent is extended or adjusted under 35 U.S.C. 154(b) by 30 days.

(21) Appl. No.: 16/789,703

(22) Filed: Feb. 13, 2020

(65) Prior Publication Data

US 2020/0266552 A1 Aug. 20, 2020

(30) Foreign Application Priority Data

Feb. 20, 2019 (CN) ..... 201910126509.3

(51) Int. Cl.

| | |
|---|---|
| ***H01Q 13/10*** | (2006.01) |
| ***H01Q 21/06*** | (2006.01) |
| *H01Q 9/06* | (2006.01) |
| *H01Q 9/16* | (2006.01) |
| *H01Q 21/00* | (2006.01) |

(52) U.S. Cl.

CPC ..... *H01Q 21/064* (2013.01); *H01Q 21/062* (2013.01); *H01Q 9/065* (2013.01); *H01Q 9/16* (2013.01); *H01Q 21/005* (2013.01)

(58) Field of Classification Search

CPC .. H01Q 21/064; H01Q 21/062; H01Q 21/005; H01Q 9/065; H01Q 9/16

See application file for complete search history.

(56) References Cited

U.S. PATENT DOCUMENTS

| | | | | |
|---|---|---|---|---|
| 6,320,553 | B1 * | 11/2001 | Ergene | H01Q 19/192 343/761 |
| 10,928,614 | B2 * | 2/2021 | Urzhumov | G02B 19/0009 |
| 2012/0194392 | A1 * | 8/2012 | Inoue | H01Q 9/0421 343/700 MS |
| 2012/0280872 | A1 * | 11/2012 | Werner | H01Q 19/062 343/753 |

(Continued)

OTHER PUBLICATIONS

Yang et al., "Design and Experiment of a Near-Zero-Thickness High-Gain Transmit-Reflect-Array Antenna Using Anisotropic Metasurface," IEEE Transactions on Antennas and Propagation, Jun. 2018, vol. 66, No. 6, pp. 2853-2861.

(Continued)

*Primary Examiner* — Joseph J Lauture

(74) *Attorney, Agent, or Firm* — Hodgson Russ LLP

(57) ABSTRACT

The present disclosure provides a spatial feeding end-fire array antenna based on electromagnetic surface technologies, including: a primary feed, configured to transmit and/or receive electromagnetic waves; and a single-layer and/or multi-layer medium-metal combination surface, configured to convert the electromagnetic waves emitted from the primary feed to an end-fire focused beam, or to concentrate space waves received in an end-fire direction into the primary feed. The single-layer and/or multi-layer medium-metal combination surface has a thickness that is equal to or less than one percent of working wavelength of the antenna.

11 Claims, 14 Drawing Sheets

(56) References Cited

U.S. PATENT DOCUMENTS

2013/0300624 A1* 11/2013 Fakharzadeh Jahromi ..... H01Q 9/065 343/793
2016/0377892 A1* 12/2016 Jou ..... G02B 6/4274 385/3

OTHER PUBLICATIONS

SIPO, First Office Action for CN Application No. 201910126509.3, dated Nov. 29, 2019.

* cited by examiner

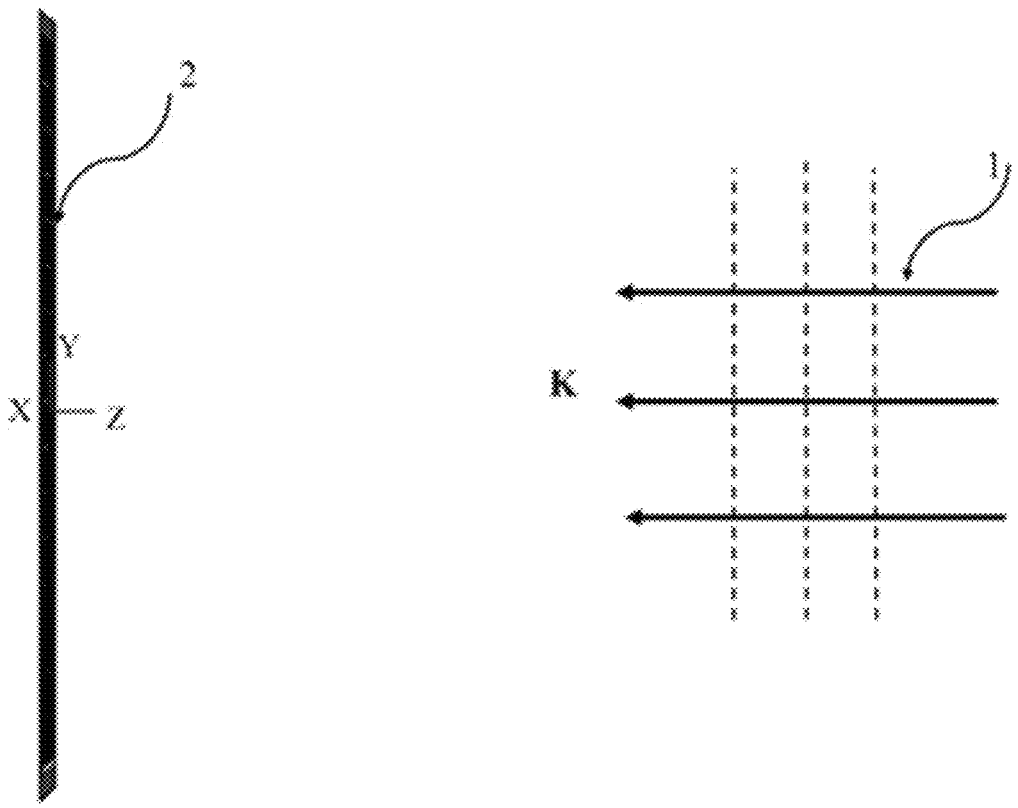
FIG. 1 (a) Space waves illuminated positively

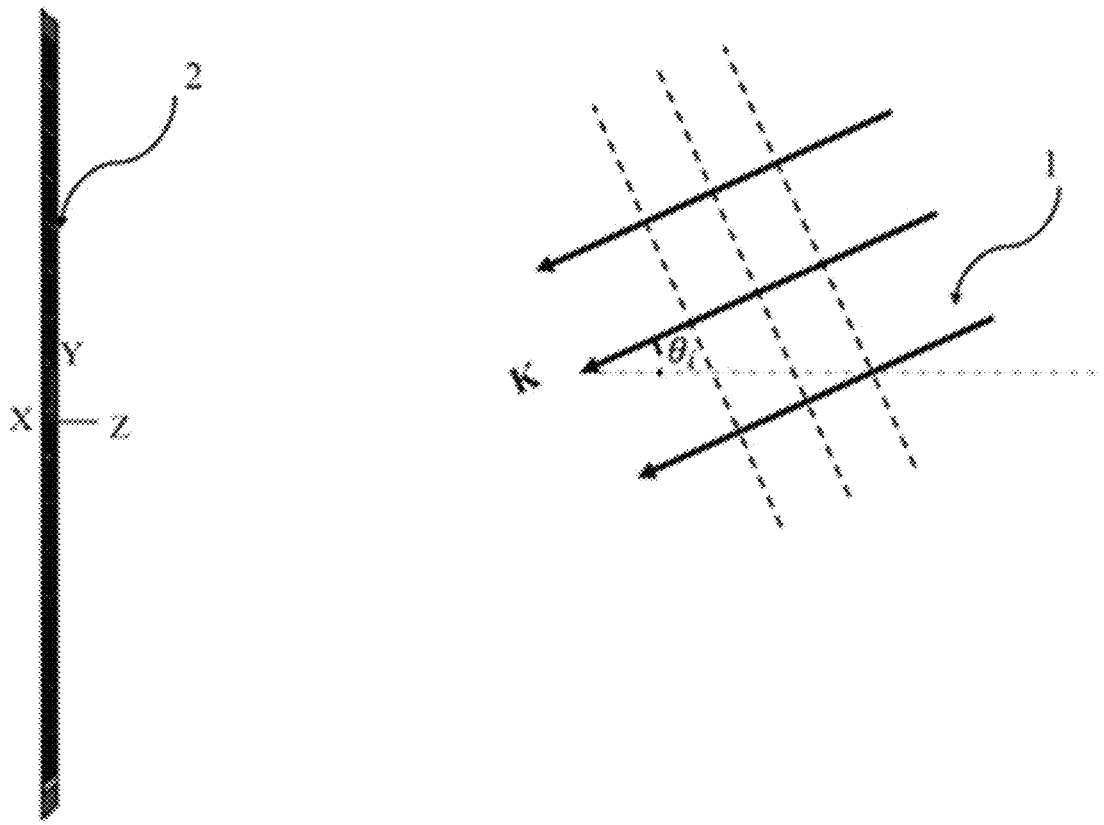
FIG. 1 (b) Space waves illuminated obliquely (Hansen-Woody array)

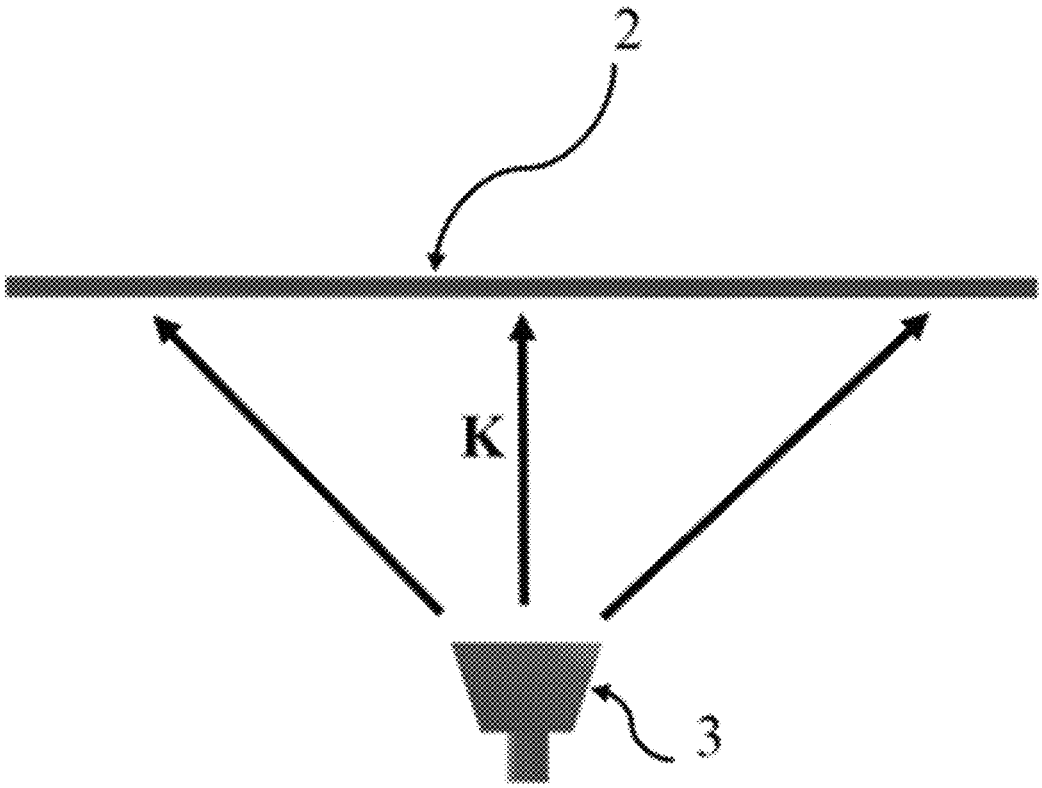
FIG. 2 (a) Feeding with far-field space-waves

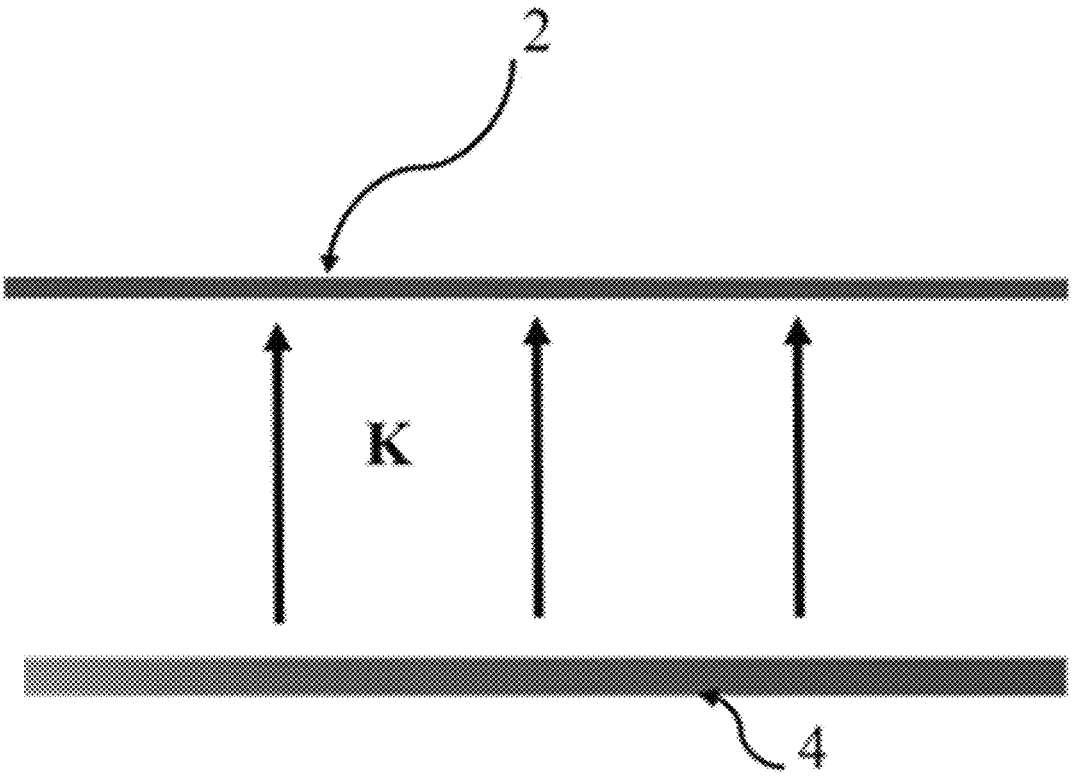
FIG. 2 (b) Feeding with near-field space-wave

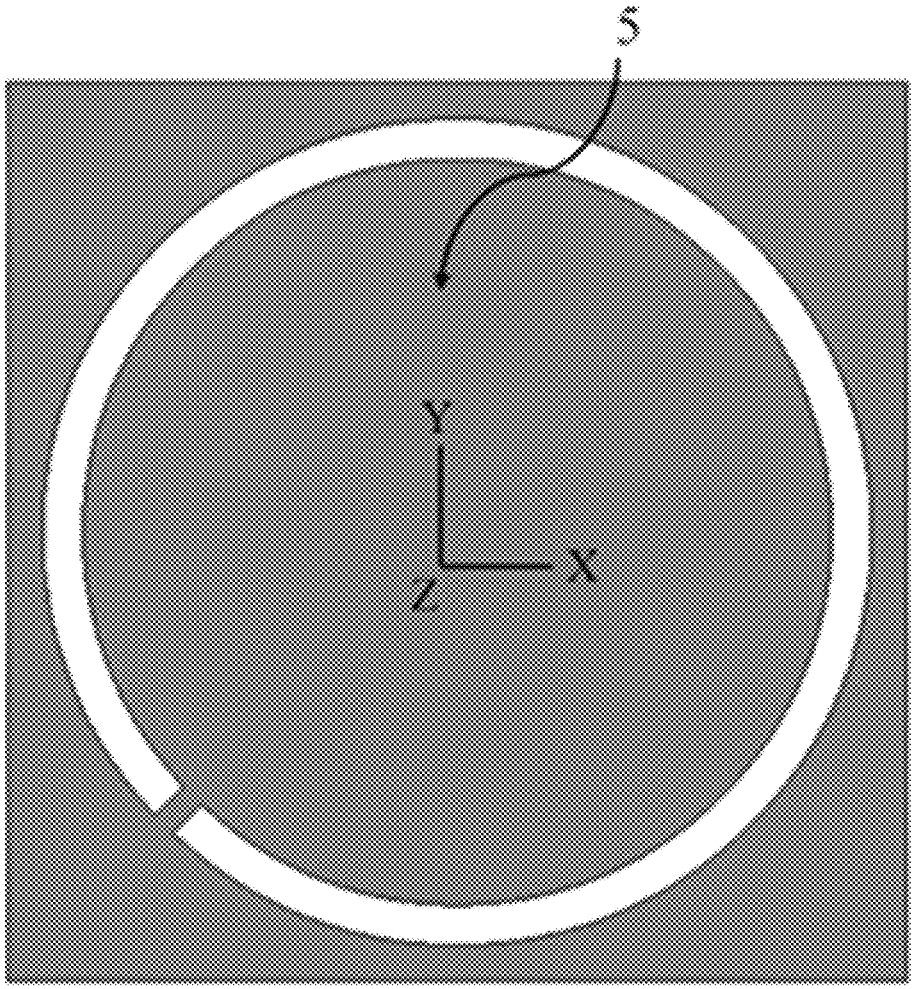
FIG. 3 (a) Element in a slot structure

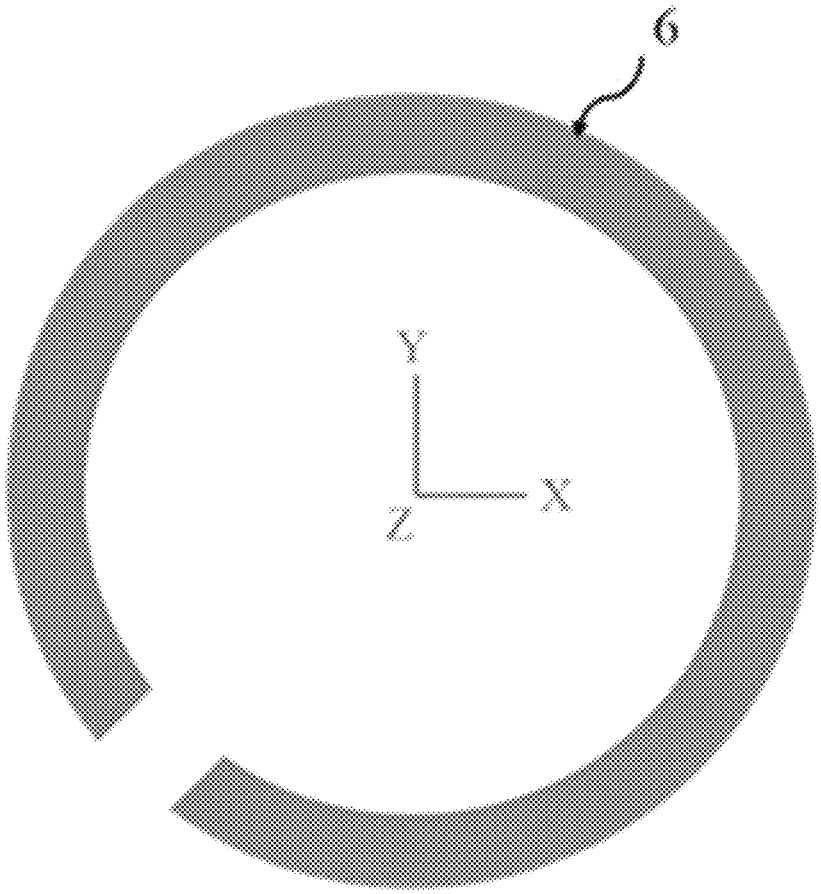
FIG. 3 (b) Element in a dipole structure

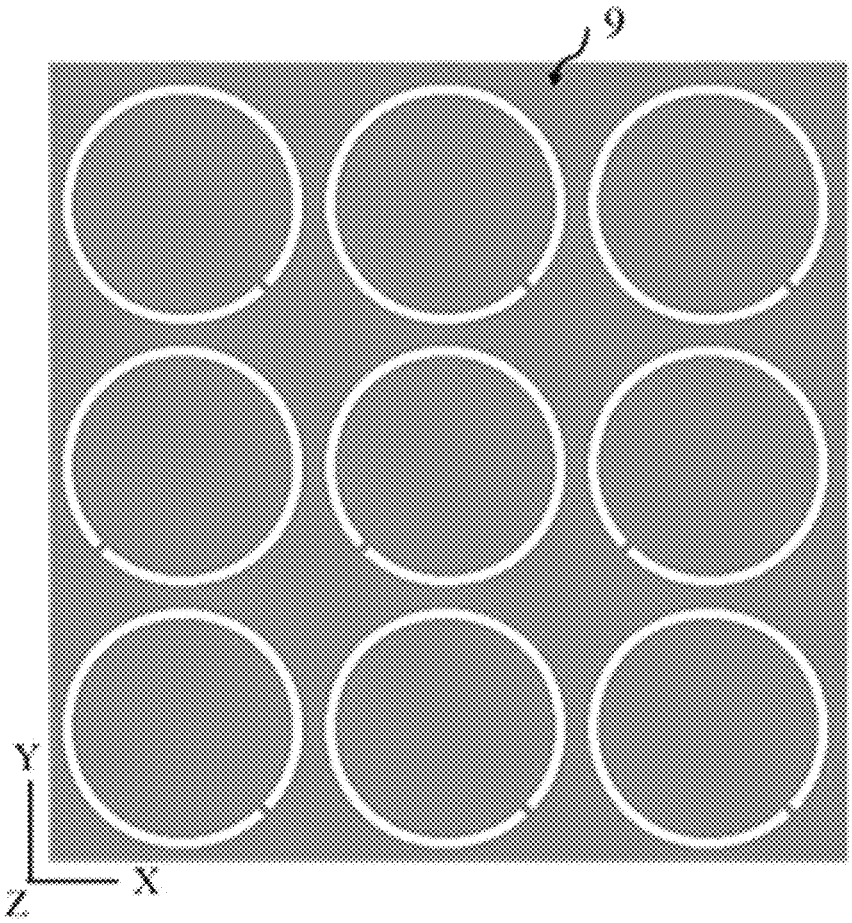
FIG. 6 (a) Partial enlargement view - Array of slots

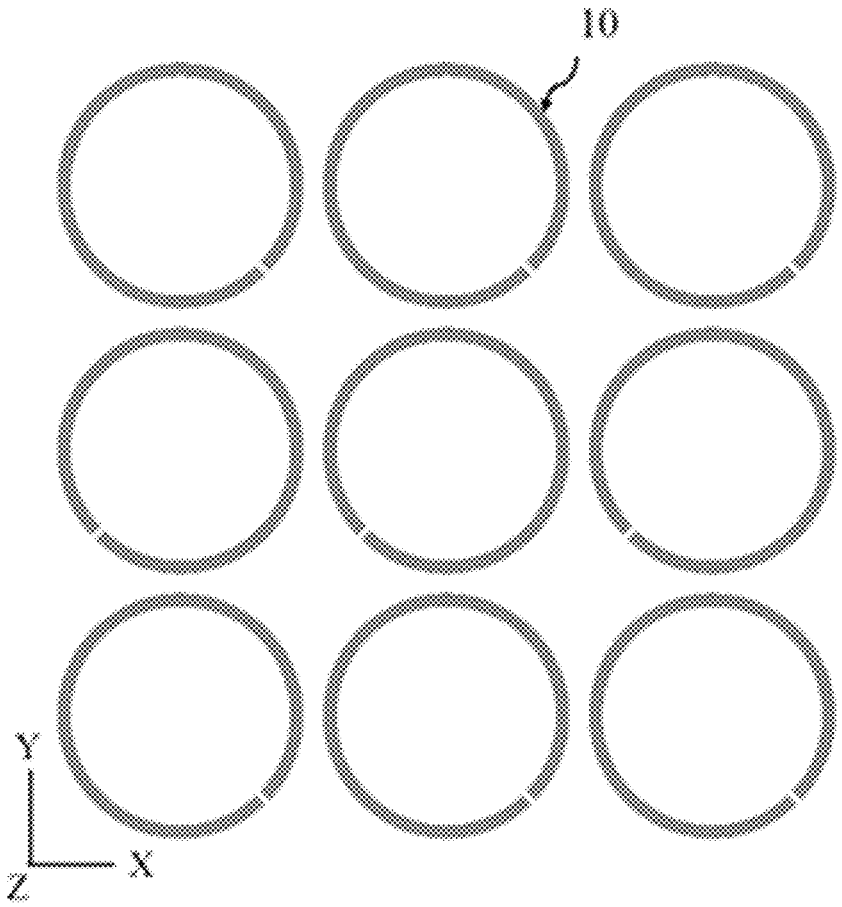
FIG. 6 (b) Partial enlargement view - Array of dipoles

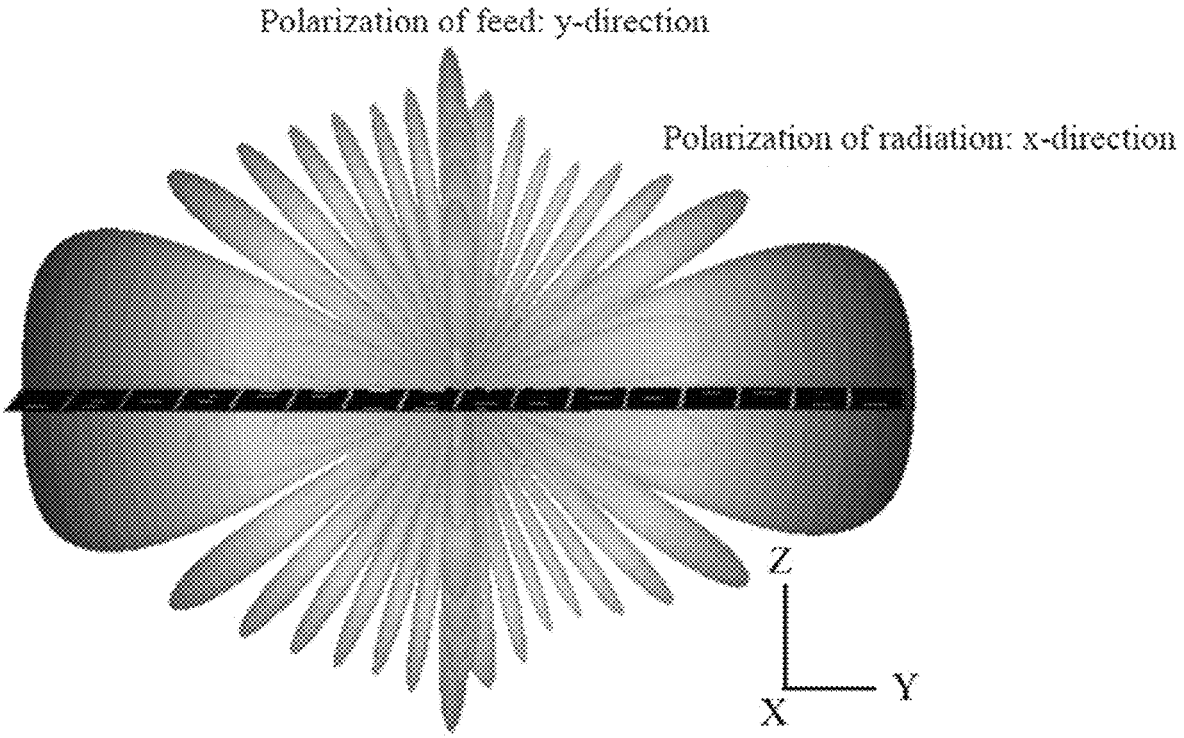
FIG. 7 (a) Space waves illuminated positively (Array of slots)

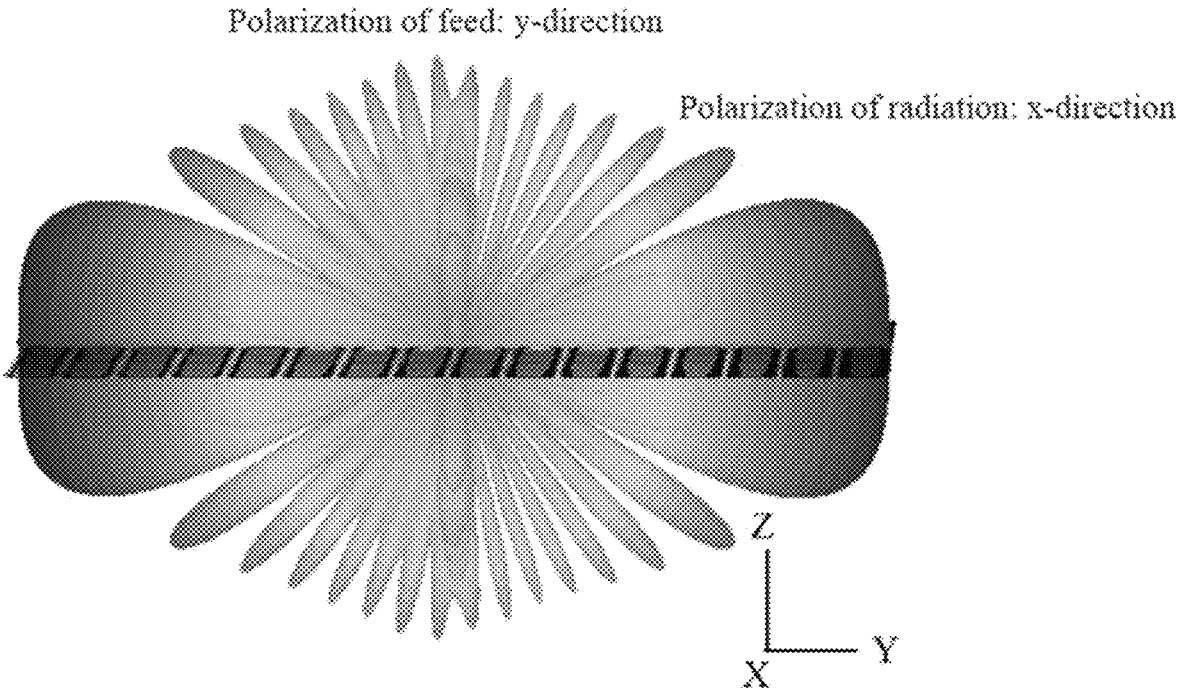
FIG. 7 (b) Space waves illuminated positively (Array of dipoles)

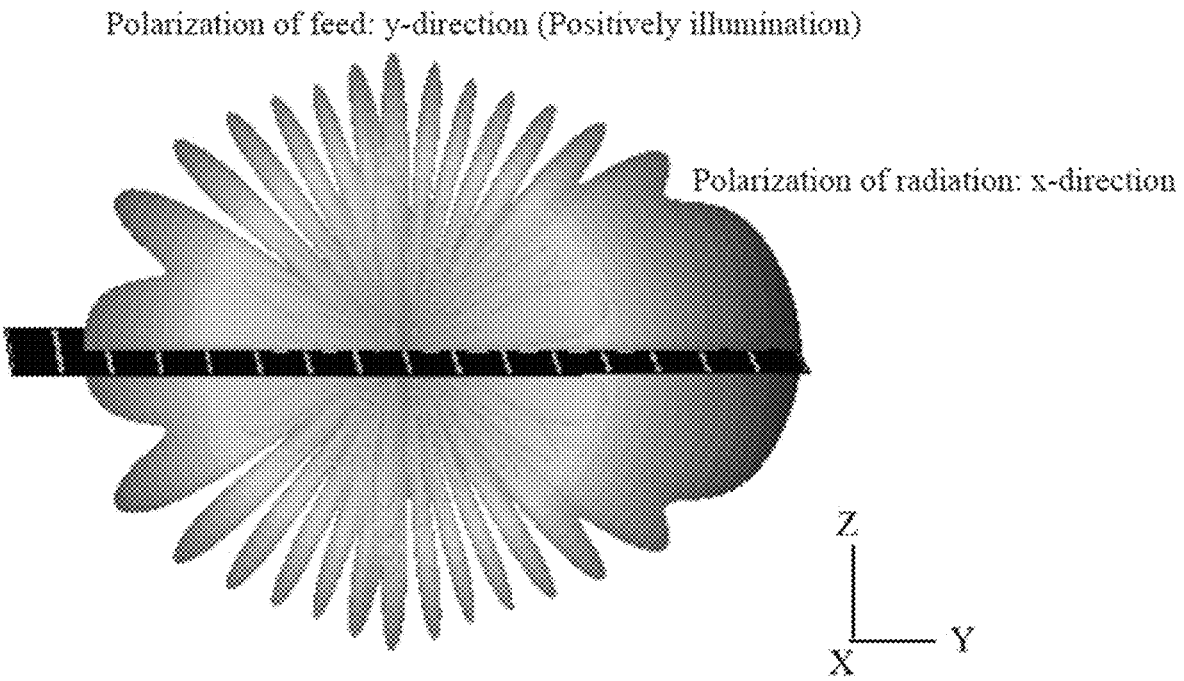
FIG. 7 (c) Space waves illuminated obliquely (Array of slots)

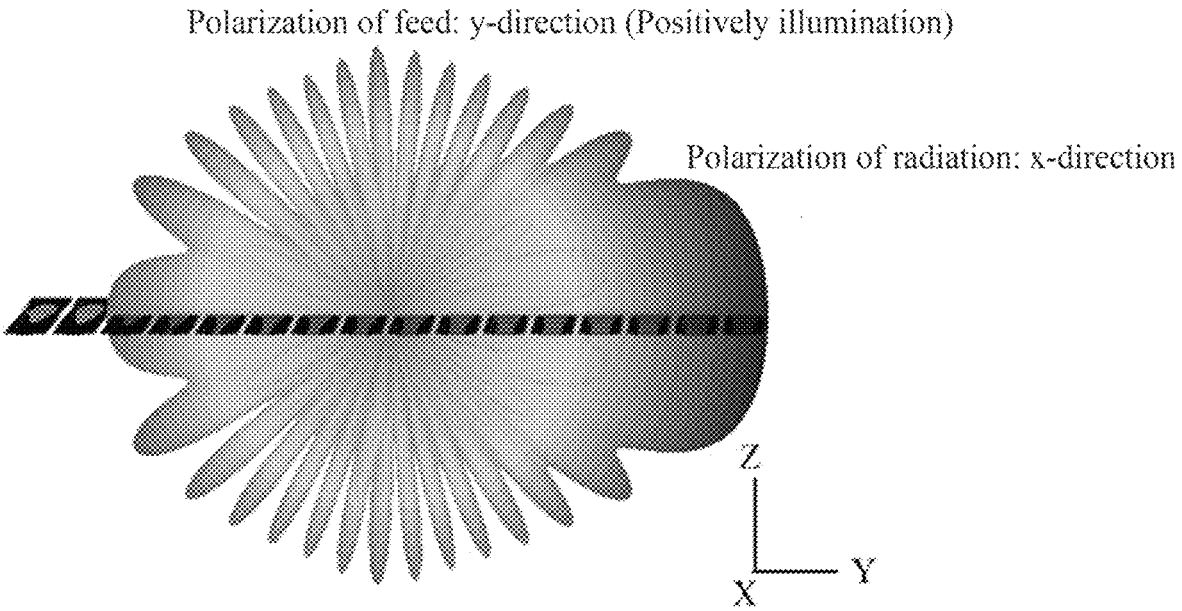
FIG. 7 (d) Space waves illuminated obliquely (Array of dipoles)

SPATIAL FEEDING END-FIRE ARRAY ANTENNA BASED ON ELECTROMAGNETIC SURFACE TECHNOLOGIES

CROSS REFERENCE TO RELATED APPLICATION

This application claims priority to Chinese Patent Application No. 201910126509.3, filed Feb. 20, 2019, the entire disclosure of which is incorporated herein by reference.

TECHNICAL FIELD

The present disclosure relates to the field of antenna technologies, and more particularly, to a spatial feeding end-fire array antenna based on electromagnetic surface technologies.

BACKGROUND

An airborne radar system is widely used in air alert patrolling, which may make up for blind areas existed in ground radar scan, and may monitor, detect, track and identify incoming aerial targets to monitor the battle-field situation. To complete preset tasks more successful, an perfect airborne radar should be provided with characteristics in two aspects. One aspect is of a wide beam coverage area and a small blind area of radar. The other aspect is of small air-resistance and lightweight, without compromising carrying capacity and maneuverability of aircrafts. However, in practice, it is difficult to fulfill both of the two aspects. Because the principle of a broadside phased array determines that in order to cover a certain airspace with a high-gain beam, an airborne phased array antenna should have a large aperture in that direction. To ensure that the scanning beam can achieve 360° omnidirectional coverage, the large aperture is to be gained at the expense of the maneuverability of the aircraft. On the other hand, to guarantee the aerodynamic of the aircraft, it is necessary to reduce the radial array aperture by sacrificing the beam coverage along the fuselage axis, which creates a blind area for radar detection. Theoretically, radiation characteristics of an end-fire array may provide a compromise between the aerodynamic of the aircraft and the coverage area of the scanning beam, which has been an interest of researchers. Meanwhile, with development of communication systems and increased communication demands, the end fire array is also highly demanded in satellite communications, mobile communications, and next-generation mobile data services.

The end-fire array antenna may form a focused beam in an end-fire direction by generating stepped phases between respective array elements in the antenna that are lagged sequentially through special means. However, there may be serious effects of mutual coupling in conventional end-fire arrays, which leads to limitation in array dimensions and difficulties in improvement of antenna gain.

SUMMARY

Embodiments of the present disclosure seek to solve at least one of the problems existing in the related art to at least some extent.

Accordingly, an object of the present disclosure is to provide a spatial feeding end-fire array antenna based on electromagnetic surface technologies, which significantly improves the antenna gain of the end-fire antenna, reduces cost, simplifies the structure, and is easy to conform and implement.

In order to achieve the above objectives, embodiments of the present disclosure provide a spatial feeding end-fire array antenna based on electromagnetic surface technologies, including: a primary feed is configured to transmit and/or receive electromagnetic waves; and a single-layer and/or multi-layer medium-metal combination surface is configured to convert the electromagnetic waves emitted from the primary feed to an end-fire focused beam, or to concentrate space waves received in an end-fire direction into the primary feed. The single-layer and/or multi-layer medium-metal combination surface has a thickness that is equal to or less than one percent of working wavelength of the antenna.

According to the embodiments of the present disclosure, the spatial feeding end-fire array antenna based on electromagnetic surface technologies can regulate the amplitude and phase of the electromagnetic waves flexibly. The antenna prevents mutual coupling between the elements by feeding with space waves, which eliminate the limitations applied to the conventional end-fire array antennas by the mutual coupling between the elements efficiently, and thus may improve the antenna gain of the end-fire antenna and implement end-fire beams with high gain. Additionally, since the array of elements is integrated on the thin electromagnetic surface, the antenna has a lightweight, an extremely low profile, a simple structure, low cost, and is easy to conform.

In addition, since the reflected beams and the transmitted beams are focused in the end-fire direction, both the reflected beams and the transmitted beams may be integrated in the same antenna, which increases the utilization of the antenna, saves space occupied by the antenna, and further reduces the size and weight of the antenna. Therefore, it is easy to implement a thinner and lighter antenna. Further, the antenna gain may increase with the increase of the antenna aperture, which effectively eliminates the element coupling limitations in conventional end-fire array antennas and realizes end-fire beams with high gain.

Additional aspects and advantages of embodiments of the present disclosure will be given in part in the following descriptions, become apparent in part from the following descriptions, or be learned from the practice of the embodiments of the present disclosure.

BRIEF DESCRIPTION OF THE DRAWINGS

The above and/or additional aspects and advantages of embodiments of the present disclosure will become apparent and more readily appreciated from the following descriptions made with reference to the drawings, in which:

FIGS. 1(*a*) and (*b*) are schematic diagrams showing the spatial feeding end-fire array antenna based on electromagnetic surface technologies according to an embodiment of the present disclosure.

FIGS. 2(*a*) and 2(*b*) illustrates schematic diagrams showing two specific forms of the space waves that may be adopted by the primary feed 1 according to the embodiments of the present disclosure, respectively.

FIGS. 3(*a*) and 3(*b*) illustrates phase modulation elements that may be used in the embodiments of the present disclosure, respectively.

FIGS. 6(*a*) and (*b*) shows partial enlargement views of the arrays illustrated in FIGS. 4 and 5, respectively.

FIGS. 7(*a*)-(*d*) illustrates schematic diagrams showing simulation results of end-fire focused beams according to the embodiments of the present disclosure, respectively.

DETAILED DESCRIPTION

Figure 4:
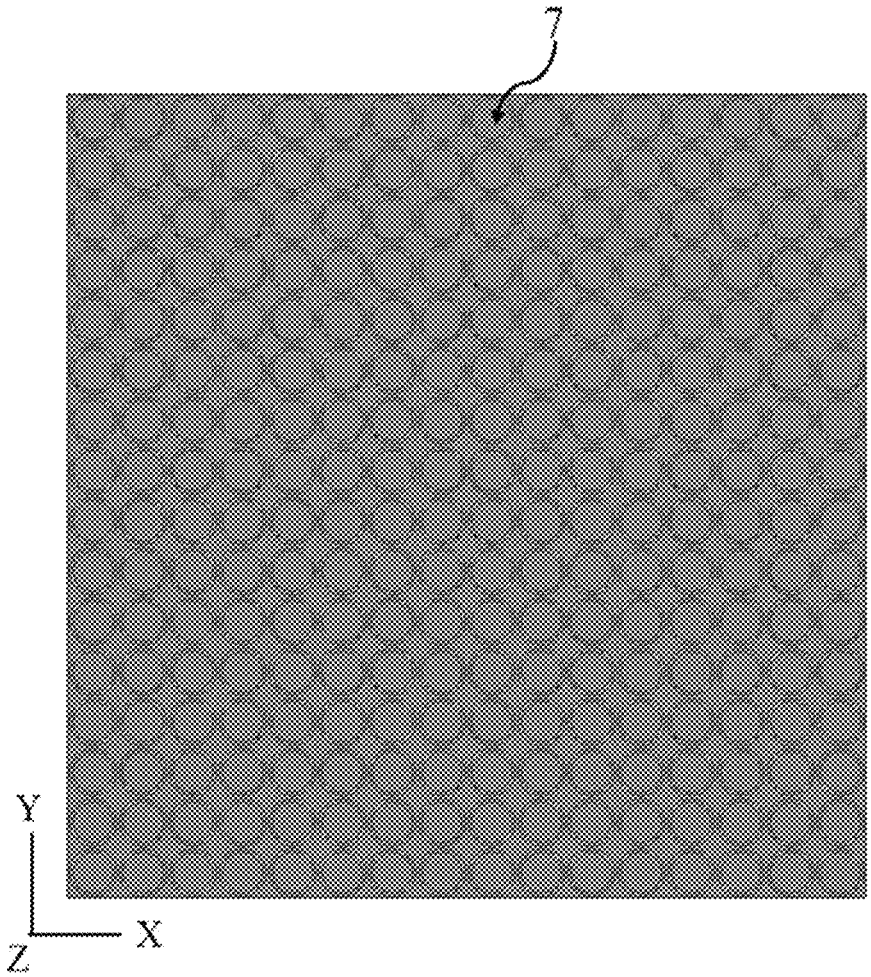
FIG. 4 is a schematic diagram of an array formed with phase modulation elements in the circular slot structure according to the embodiments of the present disclosure.

Embodiments of the present disclosure will be described in detail and examples of embodiments are illustrated in the drawings. The same or similar elements and the elements having the same or similar functions are denoted by like reference numerals throughout the descriptions. Embodiments described herein with reference to drawings are explanatory, serve to explain the present disclosure, and are not construed to limit embodiments of the present disclosure.

A spatial feeding end-fire array antenna based on electromagnetic surface technologies according to embodiments of the present disclosure will be described below with reference to accompanying drawings.

FIGS. 1(*a*) and (*b*) are schematic diagrams showing the spatial feeding end-fire array antenna based on electromagnetic surface technologies according to an embodiment of the present disclosure.

As illustrated in FIGS. 1(*a*) and (*b*), the spatial feeding end-fire array antenna based on electromagnetic surface technologies may include a primary feed 1, and a single-layer and/or multi-layer medium-metal combination surface 2. The primary feed is configured to transmit and/or receive electromagnetic waves. The single-layer and/or multi-layer medium-metal combination surface 2 is configured to convert the electromagnetic waves emitted from the primary feed to an end-fire focused beam, or to concentrate space waves received in an end-fire direction into the primary feed.

In an embodiment of the present disclosure, as shown in FIG. 1(*a*), the primary feed 1 illuminates the single-layer and/or multi-layer medium-metal combination surface 2 positively, i.e., from the front side.

In an embodiment of the present disclosure, as shown in FIG. 1(*b*), the space waves illuminates illuminated on the single-layer and/or multi-layer medium-metal combination surface 2 obliquely, e.g., as a Hansen-Woody array.

In an embodiment of the present disclosure, the primary feed 1 may be a parabolic antenna, or an array antenna. For example, the primary feed 1 may be a conventional parabolic antenna, which may be designed by those skilled in the art as necessary and is not specifically limited here.

In an embodiment of the present disclosure, the primary feed 1 may be space waves. Specifically, FIGS. 2(*a*) and 2(*b*) illustrates schematic diagrams showing two specific forms of the space waves that may be adopted as the primary feed 1 according to the embodiments of the present disclosure, respectively, in which FIG. 2(*a*) shows a feeding with far-field space-waves, and FIG. 2(*b*) shows a feeding with near-field space-wave. The polarization type of the space waves may include a y-direction polarization.

It can be understood that the primary feed 1 may be an ideal plane wave, but is not limited to it, and can also be a horn antenna, or other forms of antennas. The primary feed 1 may be one of a pyramidal horn antenna, a circular horn antenna, a corrugated horn antenna, a slotted waveguide array antenna, a microstrip array antenna and the like.

In an embodiment of the present disclosure, the thickness of the single-layer and/or multi-layer medium-metal combination surface 2 is calculated according to the electrical dimension. The thickness may be obtained based on working wavelength of the antenna, which is preferably equal to or less than one percent of the working wavelength, and is more preferably equal to or less than one thousandth of the working wavelength.

In an embodiment of the present disclosure, the single-layer and/or multi-layer medium-metal combination surface 2 may be a metal sheet. The material of the metal sheet may be aluminum, copper or stainless steel, which may be chosen by those skilled in the art as necessary and is not specifically limited here. Specifically, in the embodiment shown in FIG. 1, the single-layer and/or multi-layer medium-metal combination surface 2 is illustrated as a single-layer metal sheet, and may have a thickness of 0.02λ during a full-wave simulation process.

In an embodiment of the present disclosure, the spatial feeding end-fire array antenna based on electromagnetic surface technologies may form the focused beam in the end-fire direction.

In an embodiment of the present disclosure, an antenna gain of the antenna increases with the increase of the antenna aperture.

Further, in an embodiment of the present disclosure, a circuit design may be etched into the single-layer and/or multi-layer medium-metal combination surface 2 as a plurality of phase modulation elements. Each of the phase modulation elements may be formed in a slot structure or in a dipole structure, or other appropriate structures. For example, the slot structure may be a circular slot structure or a square slot structure.

Specifically, FIGS. 3(*a*) and 3(*b*) illustrates phase modulation elements that may be used in the embodiments of the present disclosure, respectively, in which FIG. 3(*a*) shows a first element formed in the circular slot structure 5, and FIG. 3(*a*) shows a second element formed in the dipole structure 6.

In an embodiment of the present disclosure, the spatial feeding end-fire array antenna based on electromagnetic surface technologies operates in the Ku band. The array may contain 16×16 phase-controlled radiation elements and operate at 12 GHz. It is noted that the array according to the embodiment of the present disclosure has an enhanced flexibility and expansibility and may be extended to other aperture sizes and frequency bands.

FIG. 4 is a schematic diagram obtained for processing and simulation through AutoCAD in a case in which an array is formed with the phase modulation elements in the circular slot structure 5 shown in FIG. 3(*a*) according to the embodiments of the present disclosure.

Figure 5:
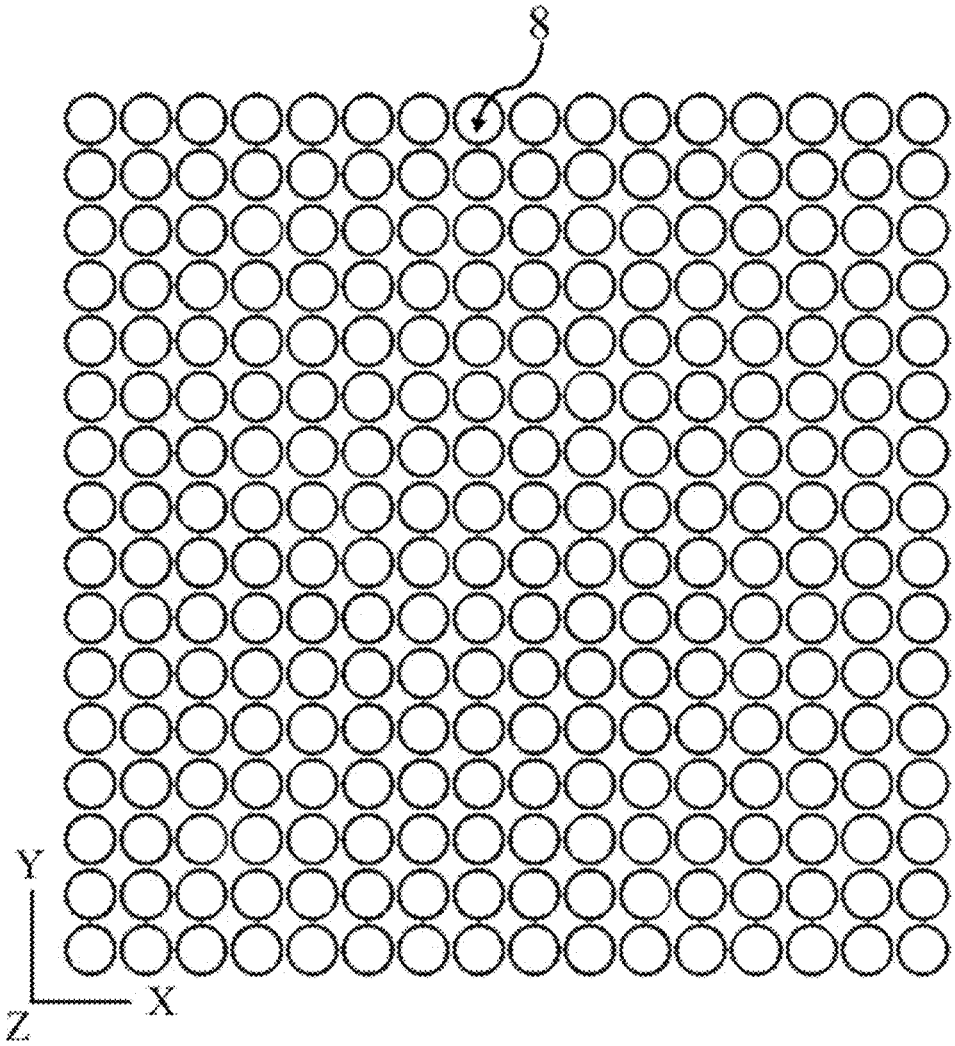
FIG. 5 is a schematic diagram of an array formed with phase modulation elements in the dipole structure according to the embodiments of the present disclosure.

FIG. 5 is a schematic diagram obtained for processing and simulation through AutoCAD in a case in which an array is formed with the phase modulation elements in the dipole structure 6 shown in FIG. 3(*b*) according to the embodiments of the present disclosure.

FIGS. 6(*a*) and (*b*) shows partial enlargement views of the arrays illustrated in FIGS. 4 and 5, respectively. As can be seen from FIG. 6, the phase modulation elements are arranged into an array in a quasi-periodic form and having a given phase distribution.

FIGS. 7(*a*)-(*d*) illustrates full-wave simulation results of reflected x-polarized and transmitted x-polarized end-fire focused beams formed when the primary feed 1 illuminates the two arrays shown in FIGS. 4 and 5 positively with the space waves of y-direction polarization, adjacently, according to the embodiments of the present disclosure, in which, FIG. 7(*a*) shows an array of slots illuminated with space waves positively; FIG. 7(*b*) shows an array of dipoles illuminated with space waves positively; FIG. 7(*c*) shows an array of slots illuminated with space waves obliquely; and FIG. 7(*d*) shows an array of dipoles illuminated with space waves obliquely.

Consequently, in the spatial feeding end-fire array antenna based on electromagnetic surface technologies according to the embodiments of the present disclosure, when the primary feed 1 illuminates the entire surface of the antenna positively, the antenna operates in both the reflective state and the transmission state. By adjusting structural parameters of respective phase modulation elements, reflected electromagnetic waves and transmitted electromagnetic waves from the phase modulation elements may be in-phase stacked in the end-fire direction, to form the focused beam.

The spatial feeding end-fire array antenna based on electromagnetic surface technologies according to the embodiments of the present disclosure may have the following advantages.

According to the embodiments of the present disclosure, the spatial feeding end-fire array antenna based on electromagnetic surface technologies may regulate the amplitude and phase of the electromagnetic waves flexibly. The antenna may prevent mutual coupling between the elements by feeding with space waves, which may eliminate the limitations applied to the conventional end-fire array antennas by the mutual coupling between the elements efficiently, and thus may improve the antenna gain of the end-fire antenna and implement end-fire beams with high gain. Additionally, since the array of elements is integrated on the electromagnetic surface, the antenna has a lightweight, an extremely low profile, a simple structure, low cost, and is easy to conform.

In addition, since the reflected beams and the transmitted beams are focused in the end-fire direction, both the reflected beams and the transmitted beams may be integrated in the same antenna, which increases the utilization of the antenna, saves space occupied by the antenna, and further reduces the size and weight of the antenna. Therefore, it is easy to implement a thinner and lighter antenna. Further, the antenna gain may increase with the increase of the antenna aperture, which effectively eliminates the element coupling limitations in conventional end-fire array antennas and realizes end-fire beams with high gain.

In addition, terms such as "first" and "second" are used herein for purposes of description and are not intended to indicate or imply relative importance or significance. Thus, the feature defined with "first" and "second" may comprise one or more this feature. In the description of the present disclosure, "a plurality of" means at least two, for example, two or three, unless specified otherwise.

Reference throughout this specification to "an embodiment," "some embodiments," "an example," "a specific example," or "some examples," means that a particular feature, structure, material, or characteristic described in connection with the embodiment or example is included in at least one embodiment or example of the present disclosure. The appearances of the above phrases in various places throughout this specification are not necessarily referring to the same embodiment or example of the present disclosure. Furthermore, the particular features, structures, materials, or characteristics may be combined in any suitable manner in one or more embodiments or examples. In addition, different embodiments or examples and features of different embodiments or examples described in the specification may be combined by those skilled in the art without mutual contradiction.

Although embodiments of present disclosure have been shown and described above, it should be understood that above embodiments are just explanatory, and cannot be construed to limit the present disclosure, for those skilled in the art, changes, alternatives, and modifications can be made to the embodiments without departing from spirit, principles and scope of the present disclosure.

What is claimed is:

1. A spatial feeding end-fire array antenna based on electromagnetic surface technologies, comprising:

a primary feed, configured to transmit and/or receive electromagnetic waves; and a single-layer and/or multi-layer medium-metal combination surface, configured to convert the electromagnetic waves emitted from the primary feed to an end-fire focused beam, or to concentrate space waves received in an end-fire direction into the primary feed, wherein, the single-layer and/or multi-layer medium-metal combination surface has a thickness that is equal to or less than one percent of working wavelength of the antenna, wherein, the antenna forms the focused beam in the end-fire direction.

2. The antenna according to claim 1, wherein the primary feed is a feed antenna of a parabolic antenna, or an array antenna.

3. The antenna according to claim 1, wherein the primary feed is space waves.

4. The antenna according to claim 3, wherein the primary feed illuminates the single-layer and/or multi-layer medium-metal combination surface positively with the space waves.

5. The antenna according to claim 3, wherein a polarization type of the space waves includes a y-direction polarization.

6. The antenna according to claim 1, wherein the primary feed is one of a pyramidal horn antenna, a circular horn antenna, a corrugated horn antenna, a slotted waveguide array antenna, and a microstrip array antenna.

7. The antenna according to claim 1, wherein a plurality of phase modulation elements are formed on the single-layer and/or multi-layer medium-metal combination surface.

8. The antenna according to claim 7, wherein structural parameters of each of the plurality of phase modulation elements are adjusted such that reflected electromagnetic waves and transmitted electromagnetic waves from the plurality of phase modulation elements are in-phase stacked in the end-fire direction, to form the focused beam.

9. The antenna according to claim 7, wherein each of the plurality of phase modulation elements is formed in a slot structure or in a dipole structure.

10. The antenna according to claim 7, wherein the plurality of phase modulation elements are arranged into an array in a quasi-periodic form and having a given phase distribution.

11. The antenna according to claim 1, wherein an antenna gain of the antenna increases as a size of an antenna aperture of the antenna increases.

* * * * *